United States Patent [19]

Soltysiak et al.

[11] Patent Number: 4,621,556

[45] Date of Patent: Nov. 11, 1986

[54] RELIEVED SERRATED DIES FOR ROTARY PUNCHING UNITS

[75] Inventors: John R. Soltysiak, Blasdell; Jimmie A. Harrod, Grand Island, both of N.Y.

[73] Assignee: Moore Business Forms, Inc., Grand Island, N.Y.

[21] Appl. No.: 608,345

[22] Filed: May 8, 1984

[51] Int. Cl.[4] ..... B26F 1/10

[52] U.S. Cl. ..... 83/670; 83/345; 83/686; 83/690

[58] Field of Search ..... 83/679–691, 83/670, 345

[56] References Cited

U.S. PATENT DOCUMENTS

| | | | |
|---|---|---|---|
| 2,085,864 | 6/1937 | Lindbom | 83/670 |
| 2,404,793 | 7/1946 | Dickerman | 83/690 |
| 3,106,859 | 10/1963 | Huffman | 83/670 |
| 4,273,015 | 6/1981 | Johnson | 83/670 |
| 4,277,944 | 7/1981 | Gargrave | 83/690 |

*Primary Examiner*—James M. Meister

*Assistant Examiner*—John L. Knoble

*Attorney, Agent, or Firm*—Allegretti, Newitt, Witcoff & McAndrews, Ltd.

[57] ABSTRACT

A serrated rotary die having a minimum die cutback angle $\theta$, wherein $$\theta \cong \arccos\left[\left(\frac{CL\ DIST}{2}\right)/RDM\right],$$

where CL DIST is the centerline distance between punch and die axes of rotation, $$RDM = \left(RD^2 + \left(\frac{MD}{2}\right)^2\right)^{\frac{1}{2}},\ RD = \frac{CL\ DIST}{2} + HT,$$

MD is a die internal diameter at the die teeth roots, and HT is the height of the die over midpoint.

4 Claims, 6 Drawing Figures

RELIEVED SERRATED DIES FOR ROTARY PUNCHING UNITS

BACKGROUND OF THE INVENTION

This invention relates to rotary punching equipment.

Rotary punching equipment, including punches and serrated dies, are employed to cut tractor feed holes in the feed strips of continuous business form assemblies. With such punches and serrated dies as now known, the punch heads are coined, or sheared off, as they enter and exit the serrated dies. This substantial wear results in frequent replacement of the punches, with substantial downtime and numbers of punches required for the punch replacement.

SUMMARY OF THE INVENTION

An object of the inventors in making this invention was to provide rotary punches and serrated dies substantially free of the wear problem of known punches and dies, to reduce the costs in material and time of worn punch replacement.

In a principal aspect, then, the invention is a rotary die having a minimum die cutback angle $\theta$. The die cutback angle $\theta$ is established according to the following formula:

$$\theta \cong \text{arc cos}\left[\left(\frac{CL\ DIST}{2}\right)/RDM\right]$$

CL DIST is the centerline distance between punch and die axes of rotation $$RDM = \left(RD^2 + \left(\frac{MD}{2}\right)^2\right)^{\frac{1}{2}}, \text{ where } RD = \frac{CL\ DIST}{2} + HT,$$

MD is a die internal diameter, and HT is the height of the die over midpoint.

BRIEF DESCRIPTION OF THE DRAWING

The preferred embodiment of the invention will be described in relation to the accompanying drawing. The drawing consists of six figures, as follows.

DETAILED DESCRIPTION OF THE PREFERRED EMBODIMENT

Figure 1:
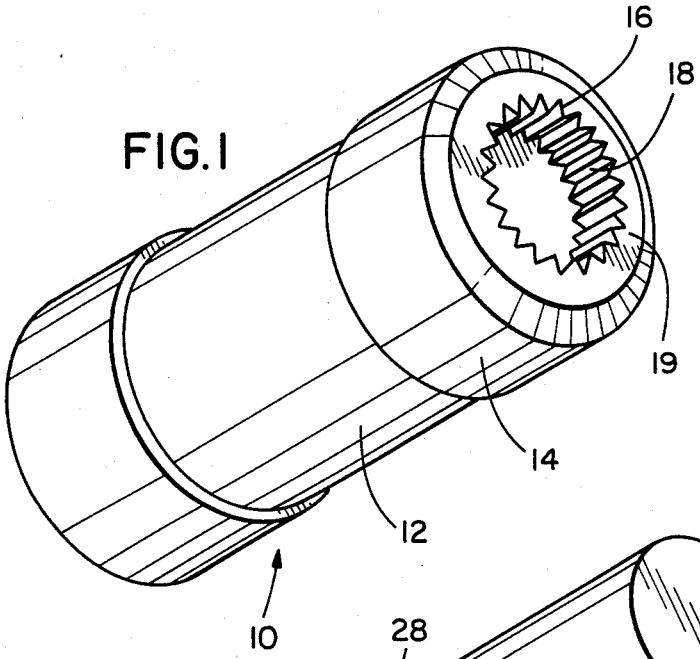
FIG. 1 is a perspective view of a preferred die of the invention.

Referring to FIG. 1, a preferred serrated die 10 of the preferred embodiment of the invention includes a cylindrical body 12 having an annular punch-engaging end 14. An internal opening 16 of the end 14 is lined with a plurality of radially inwardly directed teeth 18. In transverse cross section of the end 14, the teeth are triangular. The teeth extend longitudinally along the opening 16.

Figure 6:
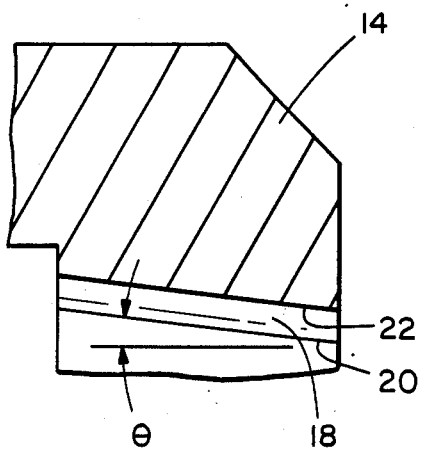
FIG. 6 is a detail view of a portion of the preferred die as shown in FIG. 4.
Figure 4:
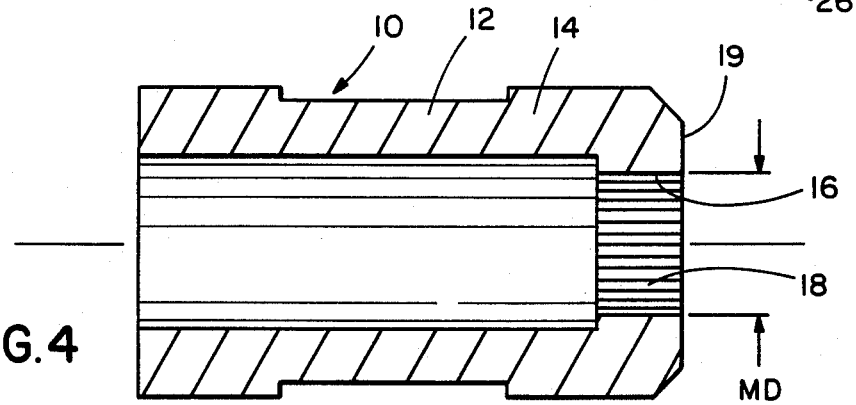
FIG. 4 is a cross-sectional view of the preferred die along the centerline of the die.

As best shown in FIG. 6, the teeth are tapered. The crests 20 and roots 22 of the teeth are angled relative to the longitudinal axis 24 (FIG. 4) of the die body 12. The minimum angle of the crests and roots to the axis is a minimum die cutback angle, designated $\theta$. The diameter of the teeth from root to root in the plane of the punch end surface 19 is designated a maximum diameter MD (FIG. 4).

Figure 2:
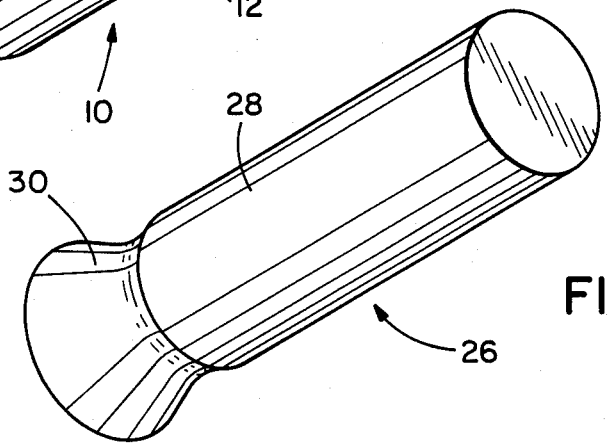
FIG. 2 is a perspective view of a preferred punch of the invention.
Figure 3:
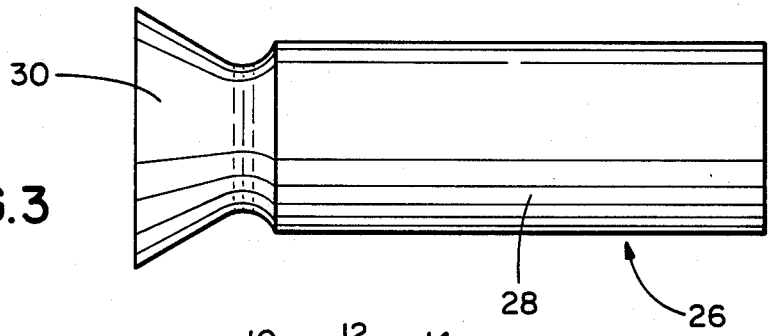
FIG. 3 is an elevation view of the preferred punch.

Referring to FIGS. 2 and 3, a preferred punch 26 of the preferred embodiment includes a cylindrical punch body 28 and a frusto-conical punch head 30. The maximum diameter of the head 30 is greater than the diameter of the body 28.

Figure 5:
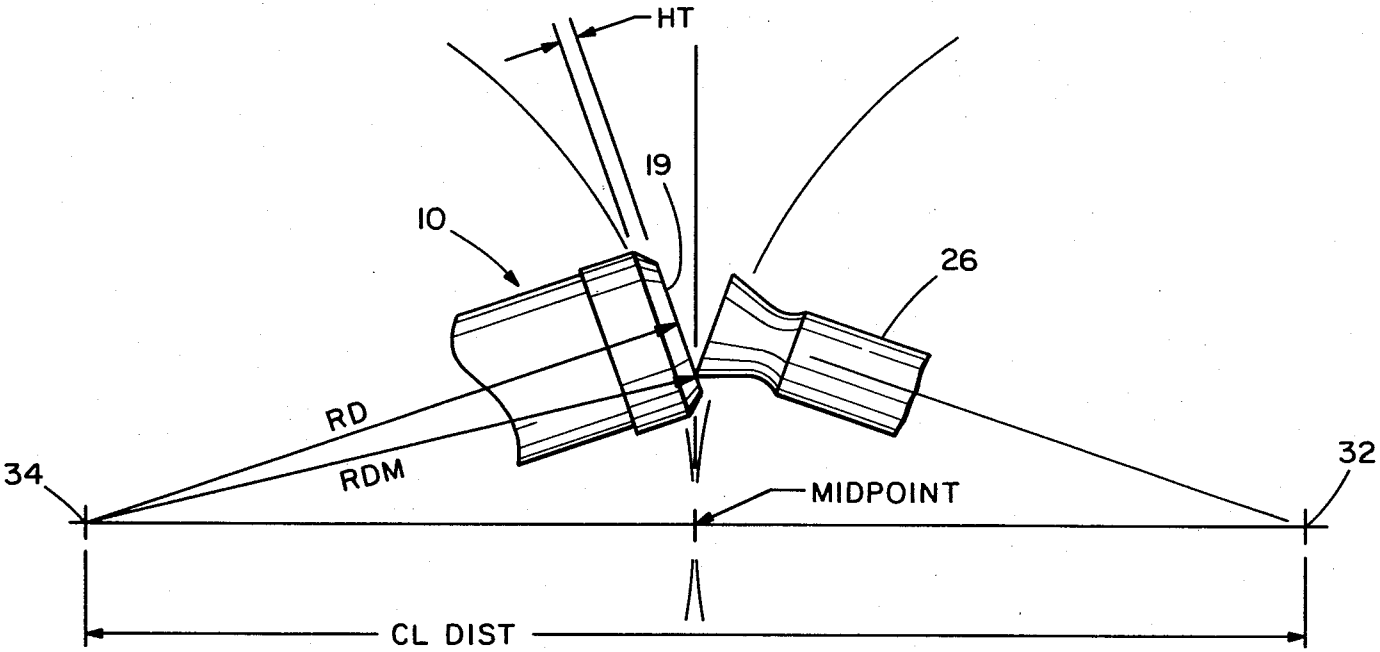
FIG. 5 is a diagrammatic view of the preferred rotary punch and die apparatus of the invention.

As shown in FIG. 5, the punch 26 and die 10 cooperate. A plurality of the punches 26 are mounted circumferentially and uniformly spaced about a punch ring (not shown) having a punch axis of rotation 32. A numerically identical plurality of dies 10 are mounted circumferentially and uniformly spaced about a die ring (not shown) having a die axis of rotation 34. The axes 32, 34 are parallel, the dies and punches are aligned in a single plane, and the punch and die rings are geared and driven together. Paper stock (not shown) is fed between the punches and dies as they rotate, and each punch cooperates with a die to cut a tractor feed hole in the paper stock.

The axes of rotation 32, 34 are separated by a centerline distance designated CL DIST. A midpoint is located along the centerline between the axes 32, 34. Each die 10 has a height over midpoint designated HT. Each punch 26 has the same height over midpoint. As shown, the height over midpoint HT is the distance by which either a die or punch extends radially outward of its axis of rotation beyond the distance from the axis to the midpoint.

The dies have a die height from the die axis of rotation 34 to the end surface 19 designated RD. The die ring height RD is equal to half the centerline distance CL DIST plus the die height over midpoint HT. Mathematically, $$RD = \frac{CL\ DIST}{2} + HT \tag{1}$$

The distance from the die axis of rotation 34 to the points along the opening 16 at the maximum diameter MD, in the plane of rotation, is designated RDM. The distance RDM is equal to the square root of the sum of the squares of the die height from the die axis RD and half the maximum root to root tooth diameter MD. Mathematically, $$RDM = \left(RD^2 + \left(\frac{MD}{2}\right)^2\right)^{\frac{1}{2}} \tag{2}$$

The angle $\theta$ is approximately equal to the arc cosine of half the centerline distance divided by the distance RDM, or $$\theta \cong \text{arc cos}\left[\left(\frac{CL\ DIST}{2}\right)/RDM\right] \tag{3}$$

As most preferred, the angle $\theta$ is exactly equal to the term of equation 3. The preferred embodiment of the invention is now described. Examplary of the preferred embodiment is a rotary punch and die press apparatus having the following physical parameters:

CL DIST=7.0028
MD=0.170
HT=0.018

With such parameters, the minimum die cutback angle $\theta$=5.96 degrees.

This preferred embodiment constitutes the best mode contemplated by the inventors of carrying out the invention. The invention, and the manner and process of making and using it, have been described in full, clear, concise and exact terms to enable any person skilled in the art to make and use the same. Because the invention may be copied without the copying of the precise details of the preferred embodiment, the following claims particularly point out and distinctly claim the subject matter which the inventors regard as their invention and wish to protect.

What we claim and regard as invention is:

1. A rotary serrated die for working with a rotary punch, said die and punch each having an axis of rotation and said die having a minimum die cutback angle $\theta$, wherein $$\theta \cong \text{arc cos}\left[\left(\frac{CL\ DIST}{2}\right)/RDM\right]$$

where CL DIST is the centerline distance between punch and die axes of rotation, said CL DIST having a midpoint, $$RDM = \left(RD^2 + \left(\frac{MD}{2}\right)^2\right)^{\frac{1}{2}}$$

$$RD = \frac{CL\ DIST}{2} + HT,$$

MD is a die internal diameter, and

HT is the height of the die, said die height defined by the distance that the die extends radially outward from the die axis of rotation beyond the distance from the die axis to the midpoint.

2. A rotary serrated die as in claim 1 in which the die height HT equals the distance by which the punch extends radially outward of the punch axis of rotation beyond the distance from the punch axis to the midpoint.

3. A rotary die as in claim 1 having die teeth defining die teeth roots and in which MD is the maximum internal diameter of the die at the die teeth roots.

4. Rotary punch and serrated die apparatus comprising:

a punch ring having an axis of rotation;

a die ring having an axis of rotation;

a plurality of punches on the punch ring; and a plurality of serrated dies on the die ring, the dies each having a minimum die cutback angle $\theta$ wherein $$\theta \cong \text{arc cos}\left[\left(\frac{CL\ DIST}{2}\right)/RDM\right]$$

where CL DIST is the centerline distance between the axes of rotation, said CL DIST having a midpoint, $$RDM = \left(RD^2 + \left(\frac{MD}{2}\right)^2\right)^{\frac{1}{2}}$$

$$RD = \frac{CL\ DIST}{2} + HT,$$

MD is a die internal diameter, and

HT is the height of the die, said die height defined by the distance that the die extends radially outward from the die axis of rotation beyond the distance from the die axis to the midpoint.

* * * * *